US007431655B2

(12) United States Patent
McCarty et al.

(10) Patent No.: US 7,431,655 B2
(45) **Date of Patent: *Oct. 7, 2008**

(54) BILLIARD CUE

(75) Inventors: Allan McCarty, Jacksonville, FL (US); Stephen Titus, Daytona Beach, FL (US)

(73) Assignee: Clawson Custom Cues, Inc., Jacksonville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/616,820

(22) Filed: Jul. 10, 2003

(65) Prior Publication Data

US 2004/0009822 A1 Jan. 15, 2004

Related U.S. Application Data

(63) Continuation of application No. 09/649,473, filed on Aug. 28, 2000, now abandoned, which is a continuation-in-part of application No. 08/825,249, filed on Mar. 27, 1997, now Pat. No. 6,162,128, which is a continuation of application No. 08/314,864, filed on Sep. 29, 1994, now Pat. No. 5,725,437, said application No. 09/649,473 and a continuation-in-part of application No. 09/200,244, filed on Nov. 25, 1998, now Pat. No. 6,110,051.

(60) Provisional application No. 60/066,589, filed on Nov. 26, 1997.

(51) Int. Cl.
*A63D 15/08* (2006.01)

(52) U.S. Cl. ..... 473/44

(58) Field of Classification Search ..... 473/44–51; 273/44–51

See application file for complete search history.

(56) References Cited

U.S. PATENT DOCUMENTS 364,680 A 6/1887 Sherwood (Continued)

FOREIGN PATENT DOCUMENTS

| | | |
|---|---|---|
| CA | 726 578 | 1/1966 |
| GB | 2 060 411 | 5/1981 |
| GB | 2 187 646 | 9/1987 |
| GB | 2 199 505 | 7/1988 |

*Primary Examiner*—Mark S Graham

(74) *Attorney, Agent, or Firm*—Hamilton, Brook, Smith & Reynolds, P.C.

(57) ABSTRACT

A billiard cue includes a shaft having a hollow bore extending for a predetermined distance from a first end of the shaft to reduce the tip end weight of the shaft. In one aspect, where the shaft is formed of a composite material consisting of fibers in a binder, such as carbon fibers in an epoxy resin, the bore forms an outer wall in the tip end of the shaft having a thickness between about 0.005 and about 0.05 inches The shaft material has a modulus of elasticity of at least $4.3\times10^6$ psi. The bore extending from the first end of the shaft, the thin wall thickness of the tip end of the shaft and the material forming the shaft combine to decrease the mass of the tip end of the shaft while maintaining substantially all of the stiffness of a conventional solid wood shaft formed of a hard maple to minimize buckling of the tip end of the shaft and thereby substantially decrease deflection of the cue ball from its intended path of movement along a path parallel to the stroke axis of the shaft. The tip end bore may be left hollow or filled with a light weight, non-structural material. The hollow bore is equally applicable to shafts formed of wood.

10 Claims, 3 Drawing Sheets

U.S. PATENT DOCUMENTS

| | | | |
|---|---|---|---|
| 608,457 | A | 8/1898 | Hutzel |
| 659,524 | A | 10/1900 | Ghezzi et al. |
| 861,158 | A | 7/1907 | Bucknum |
| 951,453 | A | 3/1910 | Ransom |
| 1,007,668 | A | 11/1911 | Barrows |
| 1,210,076 | A | 12/1916 | Jost |
| 1,252,632 | A | 1/1918 | Voje |
| 1,280,876 | A | 10/1918 | Seenan |
| 1,505,609 | A | 8/1924 | Seeman et al. |
| 1,560,456 | A | 4/1925 | Wolpert |
| 1,604,023 | A | 1/1926 | Coyle |
| 1,609,026 | A | 11/1926 | Lindley |
| 1,688,911 | A | 10/1928 | Wolpert |
| 1,702,292 | A | 2/1929 | Barrett |
| 1,705,353 | A | 3/1929 | Barrett |
| 3,334,901 | A | 8/1967 | Steffes |
| 3,342,489 | A | 9/1967 | Waldo |
| 3,476,388 | A | 11/1969 | Hackett |
| 3,598,409 | A | 8/1971 | Nemecek |
| 4,816,203 | A | 3/1989 | Son-Kung |
| 5,112,046 | A | 5/1992 | Thorpe |
| 5,267,730 | A | 12/1993 | Keaggy |
| 5,462,490 | A | 10/1995 | Donwen |
| 5,725,437 | A | 3/1998 | McCarty |
| 6,110,051 | A | 8/2000 | McCarty et al. |
| 6,162,128 | A | 12/2000 | McCarty |

BILLIARD CUE

CROSS-REFERENCE TO CO-PENDING APPLICATION

This application is a continuation of U.S. patent application Ser. No. 09/649,473, filed Aug. 28, 2000 now abandoned, the contents of which is incorporated herein by reference, which is a continuation-in-part of U.S. patent application Ser. No. 08/825,249, filed Mar. 27, 1997, now issued as U.S. Pat. No. 6,162,128, which is a continuation of U.S. application Ser. No. 08/314,864, filed Sep. 29, 1994, now U.S. Pat. No. 5,725,437, and a continuation-in-part of U.S. patent application Ser. No. 09/200,244 filed Nov. 25, 1998, now U.S. Pat. No. 6,110,051, which claims the benefit of the filing date of provisional application 60/066,589, filed Nov. 26, 1997.

BACKGROUND

1. Field of the Invention

The present invention relates, in general, to billiard cues and, more specifically, to billiard cue shafts.

2. Description of the Art

Billiard or pool cues typically are formed of an elongated shaft; a butt at one end of the shaft and a ferrule mounted at an opposite end which supports a tip. The shaft may be formed as a solid, one-piece member or of two threadingly engageable sections. Typically, the shaft has been formed of a hard wood, such as a hard maple.

Other materials, such as aluminum, steel, plastic and carbon fiber, have also used to form billiard/pool cue shafts. Cues formed of such "non-wood" materials have been engineered to approximate wood in weight and stiffness or rigidity; however none have proven to play better than a hard wood cue.

It is also known to form cue shafts of solid maple with a thin composite outer skin formed of various fibers and/or resin combinations. It is known to form a cue shaft of a solid glass bonded fiber as shown in U.S. Pat. No. 3,103,359. It is also known to form a cue shaft as a composite tube of carbon fibers in which the shaft has a wall thickness of 0.060 inches or more and the hollow interior of the shaft is filled with foam as shown in U.S. Pat. No. 4,816,203. U.S. Pat. No. 5,112,046 discloses a shaft formed of a solid epoxy resin body with a central graphite core. This shaft accommodates flexure and impact by utilizing elongated carbon filaments circumferentially spaced apart and concentrically disposed about the core and extending axially through the front and rear sections of the shaft.

Generally a billiard or pool cue is formed with one of two styles of taper. In an "American" taper, the cue has a constant diameter of approximately 0.5 inches for approximately the first twelve inches from the tip end, this being the longest bridge length commonly used in play. The other common type of taper is a so-called "European taper". In this style of cue, the cue has a truncated cone shape along its entire length tapering to a tip.

Previously devised ferrules have been formed of ivory which is substantially harder than that of the material used to form the shaft. More recently, reinforced phenolics and thermoplastics have been employed to form ferrules. Such ferrules have a modulus of elasticity ranging from a high of $1.3\times10^6$ psi to a low of $0.35\times10^6$ psi as compared to the $1.8\times10^6$ psi modulus of elasticity of hard maple commonly used to form the shaft. The ferrule is adhesively joined to and/or press fit to one end of the shaft, typically by means of a tenon in the form of a narrow diameter end portion which projects out of the end of the shaft into a hollow bore extending inward from one end of the ferrule or, alternately, from the ferrule into a bore in one end of the shaft. The tip, which is typically formed of leather, is adhesively joined to the ferrule.

In use, the shaft is lined up with the intended path of movement of the cue ball prior to stroking the shaft to impact the tip on the ball. The cue can also be lined up to strike the cue ball off center, that is, to the left or right of the center of the ball, or above or below the center of the ball, to generate spin, draw or follow to the cue ball to cause it to move in a desired direction after it strikes another ball or a rail. However, as a result of a hit to the left or right of center, the cue ball does not follow a path of movement that is parallel to the line of stroke of the cue. Rather, the cue ball deflects or moves in a path at an angle to the line of stroke of the cue. This so-called angle of deflection varies with the speed of the stroke and how far from center the cue tip strikes the cue ball, but with a given off center distance and speed, the magnitude of the angle of deflection is primarily a function of the cue itself During off center hits, the tip, ferrule and the end of the shaft up to the player's hand bridge initially buckles due to loading of the impact forces generated during impact of the tip with cue ball on an inside edge of the shaft closest to the center of the ball. This buckling is then followed by an outward flexing of the tip, ferrule and shaft end. Experimentation by the Applicants has shown that a large amount of buckling results in a larger and more undesirable deflection of the cue ball from a path of movement parallel to the cue stroke line than when buckling is minimized and the end of the cue more easily flexes or bends outward from the center of the cue ball after impact with the cue ball. Applicants have also found that a substantial amount of the cue ball deflection is due to the mass or weight of the shaft at the tip end of the shaft.

In order to address the cue ball deflection problem, the Applicants devised a billiard/pool cue disclosed in U.S. Pat. No. 5,725,437 and in co-pending application, Ser. No. 08/825,247. In both of these disclosures, a hollow bore is formed in the shaft extending from the first end for a predetermined distance toward the second or butt end. The bore forms a hollow cavity in the shaft after the ferrule is mounted on the first end of the shaft. The purpose of the bore is to reduce the weight of the tip end thereby resulting in a lighter tip end which is capable of easier outward flexing than previously devices cue shafts since the tip end can quickly accelerate laterally due to its reduced weight. The shaft of the cue disclosed in this patent and pending application is made of wood thereby necessitating large wall thicknesses for strength.

To further reduce the wall thickness of these prior cues devised by the applicants, the Applicants made refinements disclosed in co-pending application Ser. No. 09/200,244, mentioned above. In this disclosure, the Applicants devised a billiard cue having a shaft formed with the hollow bore extending from a first end and having a wall thickness of about 0.030 to about 0.050 inches. The shaft was preferably formed of fibers disposed in a binder, such as carbon fibers disposed in an expoxy resin binder. A shaft wall construction of this type typically has a modulus of elasticity of greater than $4.3\times N\ 10^6$ P.S.I. for a 0.5 inch O.D. tip and shaft in the above described wall thickness of about 0.03 inches to about 0.05 inches.

Thus, the tip end of the shaft had significantly reduced weight as compared to the applicant's previously devised wood shaft with a hollow bore at the tip end while still retaining a high degree of rigidity to produce the desired significant reduction in buckling of the cue tip upon impact with a ball.

While billiard cues were constructed by the Applicants in either the wood or fiber versions as described above with a hollow bore extending for a predetermined distance from the tip end, thereby producing the shaft with greater deflection upon impact with a cue ball without buckling, it is believed that further improvements with respect to additional reductions in tip end weight can be obtained without sacrificing the requisite stiffness to weight ratio of the billiard cue.

Thus, it would be desirable to provide a billiard cue which has a significantly reduced weight at the tip end of the shaft while maintaining sufficient stiffness to minimize flexure or buckling of the tip end of the shaft and thereby deflection of a ball struck by the cue. It would also be desirable to provide a billiard cue formed of a material having high strength and stiffness; while at the same time providing a light weight and low mass at least at the tip end of the shaft. It would also be desirable to provide a billiard cue formed of a material having a unique combination of stiffness and lightweight to enable the tip of the cue to be displaced on impact with a ball while still remaining in contact with the ball as the ball begins to rotate.

SUMMARY

The present invention is a billiard cue which significantly reduces cue ball deflection by significantly reducing the mass and/or weight of the tip end of the shaft while maintaining the shaft stiffness substantially equal to or greater than the stiffness of a comparable shaft formed of solid maple.

In a preferred embodiment, the billiard cue includes a shaft having an outer surface and first and second ends. A hollow bore extends from the first end for a predetermined distance along the length of the shaft toward the second end. The hollow bore at the tip end of the shaft can either be void of material or filled with a light weight, non-structural material which does not significantly add to the weight of the tip end of the shaft. Thus, vibration and sound dampening materials, such as foam, cotton, etc., to be placed within the bore without significantly detracting from the weight reducing features provided by the hollow tip end bore of the present invention.

The shaft can be formed of a conventional wood, such as a hard wood, and more specifically, maple. Alternately, the shaft can be formed of fibers disposed in a binder. More particularly, the shaft is formed of graphite fibers disposed in an epoxy binder.

In the latter aspect of the invention, the bore at the tip end of the shaft can be formed with a wall thickness of about 0.005 to about 0.050 inches. This reduces the weight of the tip end of the bore. However, the fiber/binder material forming the shaft, or at least at the tip end of the bore, has a significantly high stiffness to weight ratio to provide the requisite resistance to buckling on impact with a ball to reduce the deflection of the struck ball from its intended path of movement.

The hollow bore at the requisite thin wall thickness described above where the shaft is formed of either wood or a fiber/binder mixture, may be formed as an isolated bore only at the tip end of the shaft or, alternately, as part of an elongated bore extending through all or at least a substantial portion or all of the shaft. However, it is only the tip end portion of the bore which is critical to the weight reducing features of the present invention. Thus, the diameter of the bore beyond the tip end, such as beyond the point on the shaft which a billiard player normally rests the cue on a bridge formed with one hand can be solid or formed with a different diameter.

The billiard cue of the present invention is constructed to provide a significantly reduced mass or weight at the tip end of the shaft; while maintaining the stiffness of the shaft substantially equal to or greater than a conventional solid shaft made of hard maple. The reduced mass is achieved by forming a hollow bore in the shaft extending for a predetermined distance from the first end of the shaft thereby reducing the material weight at the first end of the shaft. This lower mass at the tip end of the shaft and high stiffness of the shaft material reduces flexure or buckling of the tip end of the cue shaft when the shaft impacts on a ball thereby significantly reducing the deflection of the struck ball from its intended path of movement generally parallel to the stroke axis of the cue shaft. However, the unique combination of stiffness and lightweight characteristics maintain the cue tip on the ball while allowing deflection of the tip as the ball begins to rotate.

BRIEF DESCRIPTION OF THE DRAWING

The various features, advantages and other uses of the present invention will become more apparent by referring to the following detailed description and drawing in which.

DETAILED DESCRIPTION

Figure 1:
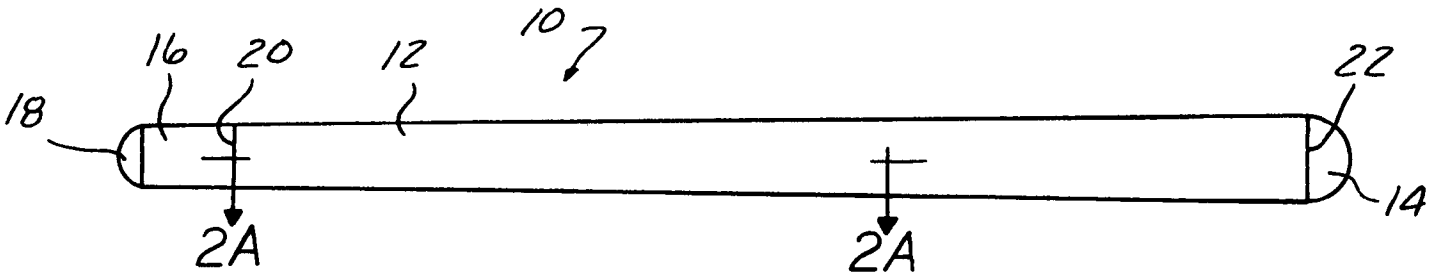
FIG. 1 is a side elevational view of a billiard cue constructed in accordance of the teachings of the present invention.
Figure 2A:
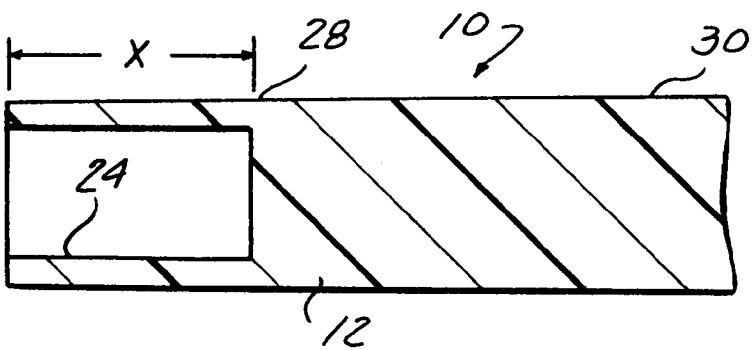
FIG. 2A is an enlarged, cross-sectional view generally taken along line 2A-2A in FIG. 1.

Referring now to the drawing, and to FIGS. 1 and 2A in particular, there is depicted a billiard/pool cue 10 constructed in accordance with the teachings of the present invention.

Figure 2B:
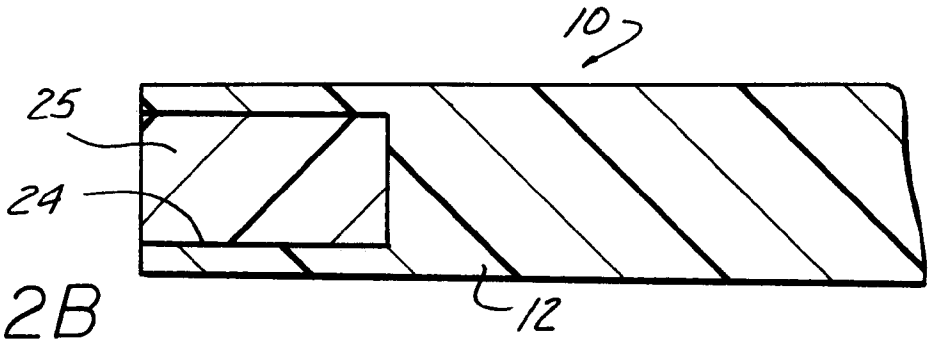
FIG. 2B is an enlarged, cross-sectional view generally taken along line 2A-2A in FIG. 1, but showing an alternate aspect of the present invention.
Figure 3:
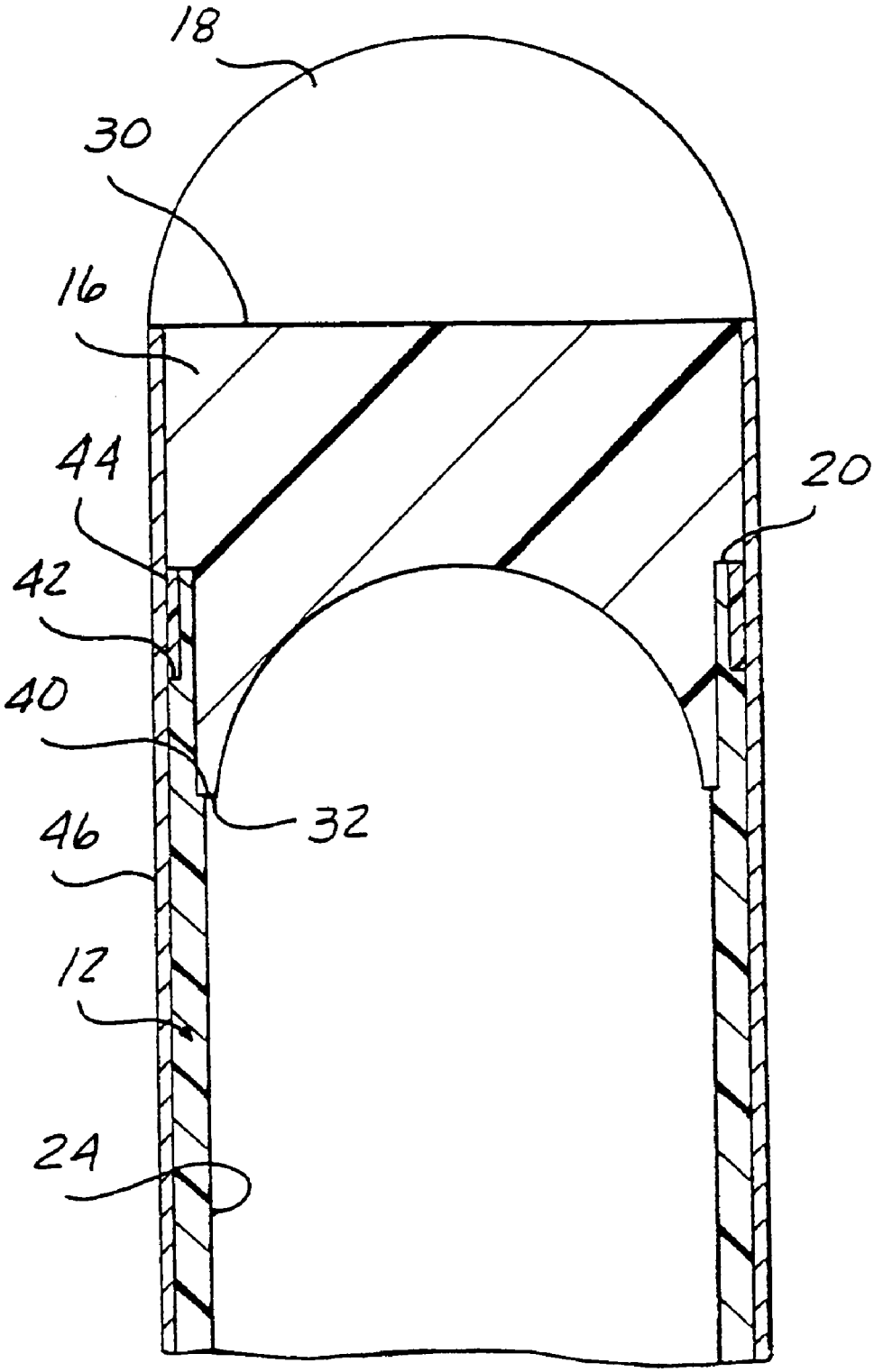
FIG. 3 is an enlarged cross-sectional view of the tip, ferrule and tip end of the shaft of the cue shown in FIG. 1.

As shown in FIGS. 1-3, the cue 10 includes a shaft 12, a butt end 14, a ferrule 16 and a tip 18. The shaft 12 may be formed of a single elongated member or two short members which are coaxially joined together.

The shaft 12 has a first end 20 on which the ferrule 16 is mounted, as described hereinafter and an opposed second end 22 to which the butt 14 is mounted in a conventional manner. A bore 24 extends through the shaft 12 at least for a predetermined distance from the first end 20. Alternately, the bore 24 of the same or different diameter may extend for the entire length of the shaft 12 between the first and second ends 20 and 22. Although an exterior surface 26 of the shaft 12 may be formed with either American or European tapers, the inner diameter or I.D. of the bore 24 can remain constant along its entire length.

In an exemplary "American taper" shaft 12, the wall thickness of the shaft 12 from the first end 22 to a point denoted by reference numeral 28 which is approximately 14-15 inches from the first end 20, is at a constant I.D. of about 0.005 to about 0.050 inches. In the "American taper" the O.D. of the shaft 12 between the first end 20 and the intermediate point 28 also remains constant.

From the point 28 to the second end 22, the exterior surface 26 of the shaft 12 tapers outwardly in a smooth, concave shape to another point 30 spaced from the second end 22 wherein it makes a convex transition to a generally straight taper of approximately 0.015 inches per inch to the second end 22.

From the intermediate point 28 to the second end 22, the wall thickness of the shaft 12 can increase as the O.D. of the shaft 12 increases toward the second end 22. Alternately, the remainder of the shaft 12 beyond the point 28 maybe a solid shaft.

The point 28 is a spaced distance "X" from the first end 20 of the shaft 12. For wood shafts by way of example only, it is contemplated that the distance "X" can be approximately four to five inches.

In another aspect, the shaft 12 is preferably formed of a composite material, such as graphite epoxy or fiber reinforced plastics, which are typically many times stronger per unit weight than hard maple. For example, graphite or carbon fibers imbedded in an epoxy resin binder may have a modulus of elasticity of greater than $4.3\times10^6$ psi for a 0.5 inch O.D. tip end shaft and the above-described wall thickness of about 0.005 to 0.050 inches. Generally, the graphite or carbon fibers, which may also be glass fibers, extend linearly along the length of the shaft 12 between the first and second ends 20 and 22. The density of the fibers changes the modulus of elasticity of the shaft 12. Thus, in an exemplary embodiment, the shaft 12 is formed of linearly extending fibers and a binder having a modulus elasticity of at least as great as $4.3\times10^6$ psi and a thin wall thickness, such as at least at the tip end 20 of the shaft 12, formed by a minimum of four or five layers of diameter of fibers. Other binder materials, such as polyester, etc. may also be employed. Thus, glass fiber/epoxy or glass fiber/polyester composites may also be employed to form the shaft 12.

As shown in FIG. 2A, the bore 24 is left void or hollow. Alternately, as shown in FIG. 2B, the bore 24 can be partially or substantially completely filled with a non-structural material, such as foam, cotton, etc., for vibration and/or sound dampening purposes. Such materials have a light weight and do not significantly detract from the weight reducing features of the tip end of the shaft 12.

In a fiber shaft construction, it is contemplated that the void or hollow bore 24 may extend for up to 10 to 12 inches.

The shaft 12 formed of fibers and having the specified modulus of elasticity and the thin wall cross-section specified above has about an 80% decrease in mass toward the tip end 20 of the shaft 12 as compared to a similar size solid maple shaft. The decreased mass at the tip end 20 of the shaft 12 increases the lateral force transmitted to the cue ball due to the necessary lateral acceleration of the tip 20 of the shaft 12. This enables the cue ball to laterally push the shaft tip end aside without buckling of the shaft.

At the same time, despite the reduced mass, the fiber material preserves approximately 94% of the stiffness of the shaft. This minimizes flexure or buckling of the tip end 20 of the shaft 12 and decreases deflection of the cue ball from its intended path of movement. Thus, the dramatically reduced tip end weight coupled with substantially the same stiffness as compared to a solid hard wood shaft increases the specific stiffness to weight ratio of the shaft.

The reduced weight tip end of the shaft 12, as described above, may also be applied to a wood shaft made of a hard wood, such as maple. In this aspect of the invention, the bore 24 is formed as described above is extending from the first end 20 of the shaft 12 to at least the point 28. The bore 24 in such a wood shaft can be hollow as shown in FIG. 2A, or filled with a lightweight, non-structural material, such as foam, cotton, etc., as shown in FIG. 2B.

In such a wood shaft with a hollow tip end bore 24, the tip end weight is reduced about 30%; while the stiffness is reduced by only about 10%. Thus, the specific stiffness to weight ratio is increased.

For completeness, a brief description of ferrule 16 and tip 18 will be provided herein. However, further details concerning the construction of the ferrule 16 and the tip 18 may be found by referring to the above-referenced and incorporated co-pending application and patent.

The ferrule 16, as shown in FIG. 3, has a generally cylindrical shape with either straight side walls or a slight taper between a first end 30 and a second end 32. The second end 32 may be generally planar or formed with a concave recess as shown by example only in FIG. 3. The ferrule 16 may be formed with a variety of materials, such as nylon, ABS, urethane, etc., as long as the ferrule 16 has greater compression in the longitudinal direction than the compressibility of a material used to form the shaft 12.

Various mounting arrangements may be employed to mount or attach the ferrule 16 to the first end 20 of the shaft 12. As shown in FIG. 3, in one exemplary mounting arrangement, an annular shoulder 40 is spaced from the first end 20 of the shaft 12 and receives a second end 32 of the ferrule 16. The side wall of the ferrule 16 is notched so as to seat against the first end 20 of the shaft 12.

The shaft 12 is further notched as shown by reference number 42 to form an annular recess extending from the first end 20. A support member 44, such as an annular band of radially extending glass or carbon fibers, is optionally wrapped around the end of the shaft 12 in the recess to increase the strength of the ferrule 16 mount to fully retain the ferrule 16 in the shaft 12.

By way of example only, an optional outer coating of a wood, such as 0.005 inch maple veneer 46, is adhesively joined to the outer surface of the shaft 12.

The tip 18 is formed of a conventional material and is typically mounted by means of an adhesive to the first end 30 of the ferrule 16. Optionally, a resilient pad, not shown, may be interposed between the tip 18 and the first end 30 of the ferrule 16.

Figure 4A:
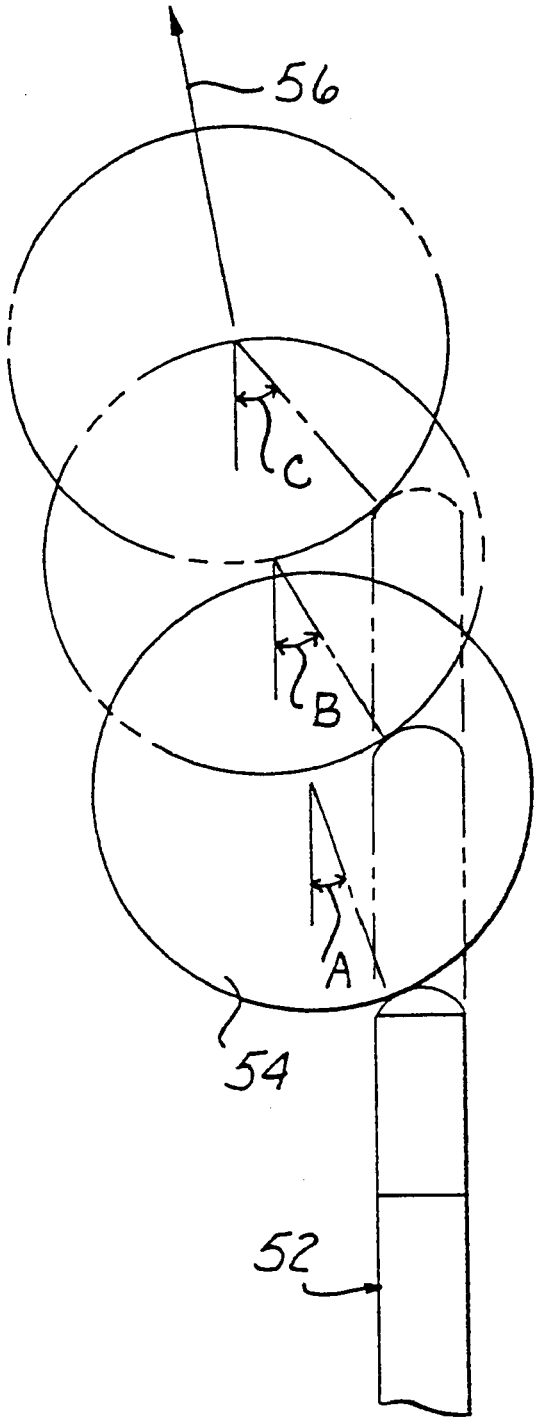
FIGS. 4A and 4B are pictorial representations depicting the impact of a conventional cue and the cue of the present invention with a ball.
Figure 4B:
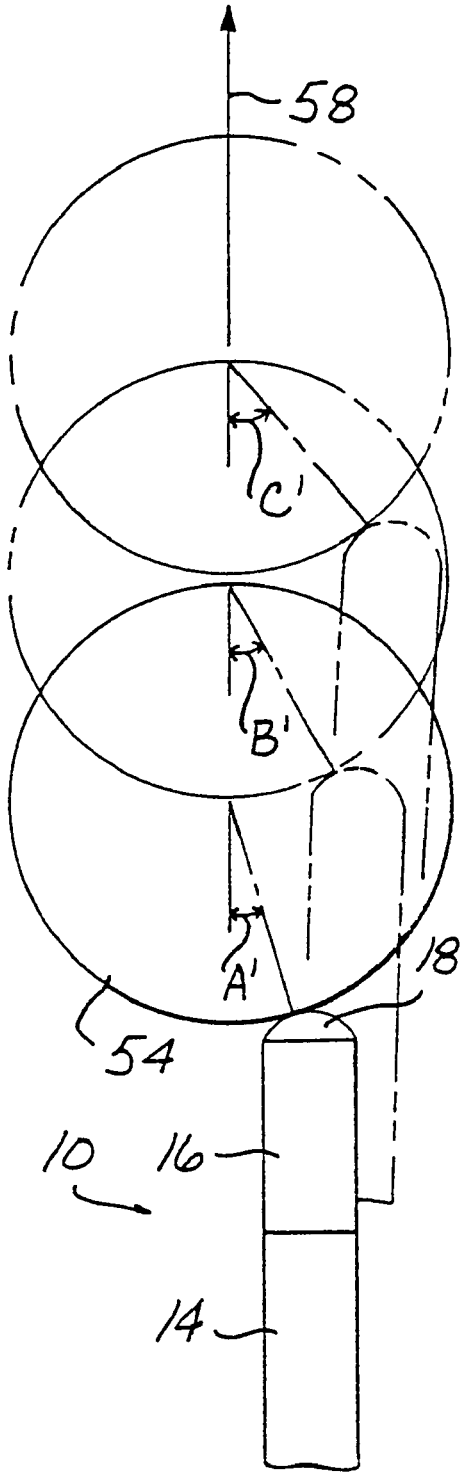

The advantages of the cue 10 of the present invention may be more clearly understood by reference to FIGS. 4A and 4B which respectively show the action of a conventional shaft 52 and a shaft 14, ferrule 16 and tip 18 of the present invention on impact with a ball 74. The conventional shaft 52, shown in FIG. 4A, is formed of hard maple. Impact forces generated during an off-center impact of the shaft 52 with a ball 54 causes the tip end of the shaft 52 to buckle inward along the inside edge of the shaft 52 pushing the shaft 52 laterally outward at increasingly larger angles A, B and C. This results in deflection of the ball 54 along path 56 which is not parallel to the stroke axis of the shaft 52.

FIG. 4B depicts the action of the tip end of the cue 10 of the present invention during impact with the ball 54. Due to the high stiffness and light weight of the tip end of the cue 10, deflection of the tip end of the shaft 12, as shown in FIG. 2B, is minimized. However, the cue 10 exhibits easy radially outward flexure, to the positions shown in phantom in FIG. 4B during impact with the ball 74, which results in less deflection of the ball 74 from a line parallel to the line of movement or stroke axis of the shaft 14. The successive angles A', B' and C' are smaller than the angles A, B, C, respectively, in FIG. 4A. The combination of light tip end weight and high stiffness enables the tip 18 of the cue 10 to remain in contact with the ball 54 without added deflection as the ball begins to rotate. As a result, the ball 54 travels along path 58 which is more closely aligned or parallel with the stroke axis of the cue 10.

In summary, there has been disclosed a unique billiard cue having a unique shaft construction which minimizes buckling of the tip end of the shaft and significantly reduces the amount of deflection of a cue ball struck by the shaft from an intended path of movement generally parallel to the longitudinal stroke axis of the shaft.

What is claimed:

1. A billiard cue comprising:

a shaft having a tip end and an opposed end and formed of a composite material including fibers disposed in a binder, the composite material forming a cylindrical wall having a wall thickness of less than 0.050 inches between opposed first and second ends of a bore, the bore being defined by the cylindrical wall and extending from the tip end toward the second opposed end of the shaft, resulting in the tip end of the shaft having an increased stiffness-to-weight ratio, compared to a solid shaft, that promotes lateral deflection of the tip end of the shaft during an off-center strike on a cue ball to minimize cue ball deflection.

2. The billiard cue of claim 1 wherein the fibers are carbon fibers in an epoxy resin binder.

3. The billiard cue of claim 1 further comprising:

a lightweight, non-structural material disposed in at least a portion of the bore, the addition of the lightweight, non-structural material not substantially decreasing the stiffness-to-weight ratio of the shaft.

4. The billiard cue of claim 1 wherein the bore is substantially hollow over its entire length.

5. The billiard cue of claim 1 wherein the cylindrical wall is surrounded by an outer layer of a wood material.

6. The billiard cue of claim 5 wherein the outer layer of wood material is adhesively joined to the cylindrical wall.

7. A billiard cue, comprising:

a shaft having a tip end and an opposed end, the shaft formed of wood and a composite material including fibers disposed in a binder, the composite material forming a cylindrical wall defining a bore, the bore extending from the tip end of the shaft towards the opposed end of the shaft, the cylindrical wall having a wall thickness of less than 0.050 inches along the length of the bore.

8. The billiard cue of claim 7, wherein the bore is substantially hollow over its entire length.

9. The billiard cue of claim 7, wherein the cylindrical wall of composite material has an outer coating of a wood material.

10. The billiard cue of claim 9, wherein the wood material is adhesively joined to the composite material.

* * * * *